US010526164B2

(12) United States Patent
Barnett et al.

(10) Patent No.: US 10,526,164 B2
(45) Date of Patent: Jan. 7, 2020

(54) SYSTEM AND METHOD FOR A FLEXIBLE PIPE CONTAINMENT SLED

(71) Applicant: Trinity Bay Equipment Holdings, LLC, Houston, TX (US)

(72) Inventors: Alexander Barnett, Houston, TX (US); Matthew Hegler, Houston, TX (US)

(73) Assignee: Trinity Bay Equipment Holdings, LLC, Houston, TX (US)

( * ) Notice: Subject to any disclaimer, the term of this patent is extended or adjusted under 35 U.S.C. 154(b) by 136 days.

(21) Appl. No.: 15/681,451

(22) Filed: Aug. 21, 2017

(65) Prior Publication Data

US 2019/0055106 A1 Feb. 21, 2019

(51) Int. Cl.

| | |
|---|---|
| ***B65H 75/40*** | (2006.01) |
| ***B65H 75/44*** | (2006.01) |
| ***B65H 57/04*** | (2006.01) |
| ***B65H 57/26*** | (2006.01) |

(52) U.S. Cl.

CPC ..... *B65H 75/40* (2013.01); *B65H 75/44* (2013.01); *B65H 2701/33* (2013.01)

(58) Field of Classification Search

CPC ..... B65H 54/28; B65H 75/36; B65H 75/40; B65H 75/44; B65H 2701/33; F16L 1/032

See application file for complete search history.

(56) References Cited

U.S. PATENT DOCUMENTS 2,595,655 A * 5/1952 Hannay ..... B65H 75/38 137/355.2
2,738,143 A * 3/1956 Hannay ..... B65H 75/441 242/157.1
3,372,461 A * 3/1968 Tesson ..... F16L 1/203 228/155
3,712,100 A * 1/1973 Key ..... F16L 1/18 405/168.3
3,849,999 A 11/1974 Coffey
3,965,713 A * 6/1976 Horton ..... B21C 47/22 72/146

(Continued)

FOREIGN PATENT DOCUMENTS

| | | |
|---|---|---|
| FR | 2556812 | 6/1985 |
| GB | 1137473 | 12/1968 |

(Continued)

OTHER PUBLICATIONS

United States Patent and Trademark Office; PCT International Search Report and Written Opinion, issued in connection to PCT/US18/44969; dated Dec. 10, 2018; 12 pages; U.S.

*Primary Examiner* — William A. Rivera

(74) *Attorney, Agent, or Firm* — Greenberg Traurig, LLP; Dwayne Mason; Mark Chretien

(57) ABSTRACT

A flexible pipe containment sled includes a platform and a first sled portion coupled to a bottom surface of the platform. The first sled portion is disposed at a first side of the platform. The sled also includes a second sled portion coupled to the bottom surface of the platform. The second sled portion is disposed at a second side of the platform opposite to the first side of the platform. The sled also includes a passage formed between the first and second sled portions. The passage is configured to allow a flexible pipe to pass through the passage while the flexible pipe containment sled is placed on a surface.

21 Claims, 7 Drawing Sheets

(56) References Cited

U.S. PATENT DOCUMENTS

| | | | | | |
|---|---|---|---|---|---|
| 3,982,402 | A * | 9/1976 | Lang | B63B 35/03 | 405/168.3 |
| 4,228,553 | A | 10/1980 | Genuuit | | |
| 5,139,751 | A * | 8/1992 | Mansfield | B05B 13/06 | 118/306 |
| 5,454,431 | A | 10/1995 | Ledwig | | |
| 5,606,921 | A | 3/1997 | Elder et al. | | |
| 6,419,424 | B1 * | 7/2002 | Null | B65H 49/24 | 242/557 |
| 7,566,024 | B2 * | 7/2009 | Krise | B60P 1/6463 | 242/397.1 |
| 2008/0029645 | A1 | 2/2008 | Gideon et al. | | |
| 2012/0061504 | A1 * | 3/2012 | Powell | B65H 49/24 | 242/564 |
| 2014/0312156 | A1 | 10/2014 | Minino et al. | | |

FOREIGN PATENT DOCUMENTS

| | | | | |
|---|---|---|---|---|
| GB | 2471488 A * | 1/2011 | B65H 49/24 | |
| SE | 458798 | 5/1989 | | |
| WO | 2011/001183 | 1/2011 | | |
| WO | 2019/028231 | 2/2019 | | |

* cited by examiner

SYSTEM AND METHOD FOR A FLEXIBLE PIPE CONTAINMENT SLED

BACKGROUND

Flexible pipe is useful in a myriad of environments, including in the oil and gas industry. Flexible pipe may be durable and operational in harsh operating conditions and can accommodate high pressures and temperatures. Flexible pipe may be bundled and arranged into one or more coils to facilitate transporting and using the pipe.

Coils of pipe may be positioned in an "eye to the side" or "eye to the sky" orientation. When the flexible pipe is coiled and is disposed with its interior channel facing upwards, such that the coil is in a horizontal orientation, then the coils of pipe are referred to as being in an "eye to the sky" orientation. If, instead, the flexible pipe is coiled and disposed such that the interior channel is not facing upwards, such that the coil is in an upright or vertical orientation, then the coils of pipe are referred to as being in an "eye to the side" orientation.

The flexible pipe may be transported as coils to various sites for deployment (also referred to as uncoiling or unspooling). Different types of devices and vehicles are currently used for loading and transporting coils of pipe, but usually extra equipment and human manual labor is also involved in the process of loading or unloading such coils for transportation and/or deployment. Such coils of pipe are often quite large and heavy. Accordingly, there exists a need for an improved method and apparatus for loading and unloading coils of pipe.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to a flexible pipe containment sled that includes a platform and a first sled portion coupled to a bottom surface of the platform. The first sled portion is disposed at a first side of the platform. The sled also includes a second sled portion coupled to the bottom surface of the platform. The second sled portion is disposed at a second side of the platform opposite to the first side of the platform. The sled also includes a passage formed between the first and second sled portions. The passage is configured to allow a flexible pipe to pass through the passage while the flexible pipe containment sled is placed on a surface.

In another aspect, embodiments of the present disclosure relate to a method that includes placing the flexible pipe containment sled on a surface. The flexible pipe containment sled includes a platform and a first sled portion coupled to a bottom surface of the platform. The first sled portion is disposed at a first side of the platform. The sled also includes a second sled portion coupled to the bottom surface of the platform. The second sled portion is disposed at a second side of the platform opposite to the first side of the platform. The sled also includes a passage formed between the first and second sled portions. The method also includes passing a flexible pipe through the passage.

Other aspects and advantages of the claimed subject matter will be apparent from the following description and the appended claims.

DETAILED DESCRIPTION

Figure 1:
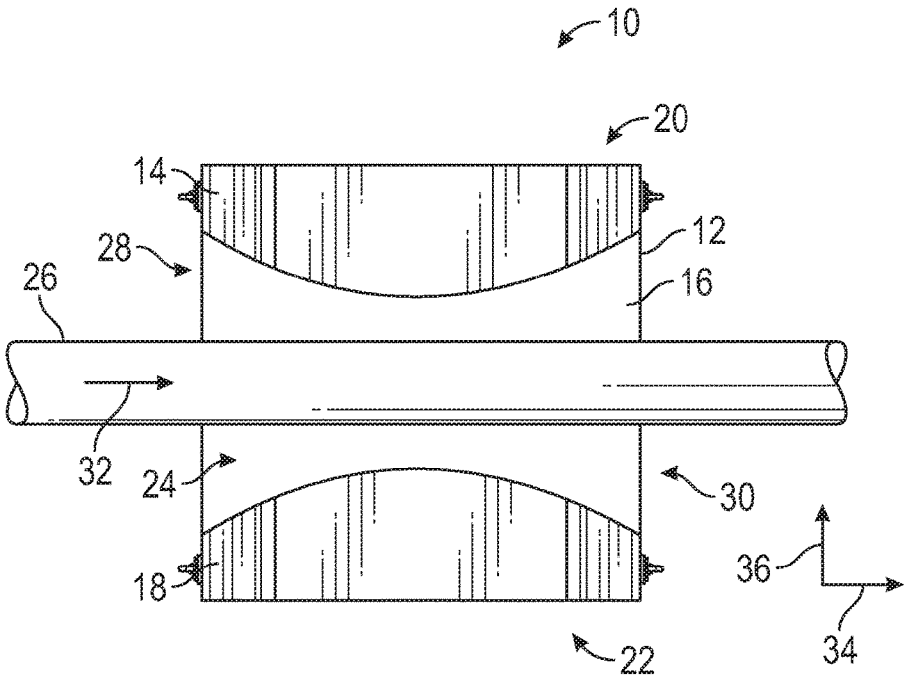
FIG. 1 is a bottom view of a flexible pipe containment sled according to embodiments of the present disclosure.

Embodiments of the present disclosure relate generally to systems using for deploying coils of flexible pipe. The coils of pipe may be self-supported, for example, using bands to hold coils together, or the coils of pipe may be supported around a reel (which may be referred to as a reel of pipe). Deployment systems according to embodiments of the present disclosure may include a flexible pipe containment sled that includes a platform and a first sled portion coupled to a bottom surface of the platform. The first sled portion is disposed at a first side of the platform. The sled also includes a second sled portion coupled to the bottom surface of the platform. The second sled portion is disposed at a second side of the platform opposite to the first side of the platform. The sled also includes a passage formed between the first and second sled portions. The passage is configured to allow the flexible pipe to pass through the passage while the flexible pipe containment sled is placed on a surface.

Embodiments of the present disclosure will be described below with reference to the figures. In one aspect, embodiments disclosed herein relate to embodiments for containing deploying flexible pipe by passing the flexible pipe through the passage of the flexible pipe containment sled.

As used herein, the term "coupled" or "coupled to" may indicate establishing either a direct or indirect connection, and is not limited to either unless expressly referenced as such. The term "set" may refer to one or more items. Wherever possible, like or identical reference numerals are used in the figures to identify common or the same elements.

The figures are not necessarily to scale and certain features and certain views of the figures may be shown exaggerated in scale for purposes of clarification.

FIG. 1 illustrates a bottom view of an embodiment of a flexible pipe containment sled 10. As described in detail below, the sled 10 includes a platform 12. A first sled portion 14 may be coupled to a bottom surface 16 of the platform 12 and a second sled portion 18 may be coupled to the bottom surface 16 of the platform 12. As shown in FIG. 1, the first sled portion 14 may be disposed at a first side 20 of the platform 12 and the second sled portion 18 may be disposed at a second side 22 of the platform 12. A passage 24 may be formed between the first sled portion 14 and the second sled portion 18. As shown in FIG. 1, the passage 24 is configured to enable a flexible pipe 26 to pass through the passage 24 while the sled 10 is placed on a surface, as described in more detail below. The flexible pipe 26 may enter an inlet 28 of the passage 24 and exit an outlet 30 of the passage 24 in the direction of arrow 32. Various features of the sled 10 may be described with respect to an longitudinal axis or direction 34 and a perpendicular axis or direction 36. For example, the flexible pipe 26 may generally move through the passage 24 parallel to the longitudinal direction 34. In addition, embodiments of the sled 10 may be symmetric about the perpendicular axis 36, which may simplify use and handling of the sled 10. In other words, the sled 10 may be used with the flexible pipe 26 entering either the inlet 28 or the outlet 30.

Pipe, as understood by those of ordinary skill, may be a tube to convey or transfer any water, gas, oil, or any type of fluid known to those skilled in the art. The flexible pipe 26 may be made of any type of materials including without limitation plastics, metals, a combination thereof, composites (e.g., fiber reinforced composites), or other materials known in the art. The flexible pipe 26 is used frequently in many applications, including without limitation, both onshore and offshore oil and gas applications. Flexible pipe 26 may include Flexible Composite Pipe (FCP) or Reinforced Thermoplastic Pipe (RTP). A FCP/RTP pipe may itself be generally composed of several layers. In one or more embodiments, flexible pipe 26 may include a high-density polyethylene ("HDPE") pipe having a reinforcement layer and an HDPE outer cover layer. Thus, flexible pipe 26 may include different layers that may be made of a variety of materials and also may be treated for corrosion resistance. For example, in one or more embodiments, pipe used to make up a coil of pipe may have a corrosion protection shield layer that is disposed over another layer of steel reinforcement. In this steel-reinforced layer, helically wound steel strips may be placed over a liner made of thermoplastic pipe. Flexible pipe 26 may be designed to handle a variety of pressures. Further, flexible pipe 26 may offer unique features and benefits versus steel/carbon steel pipe lines in the area of corrosion resistance, flexibility, installation speed and re-usability.

Figure 2:
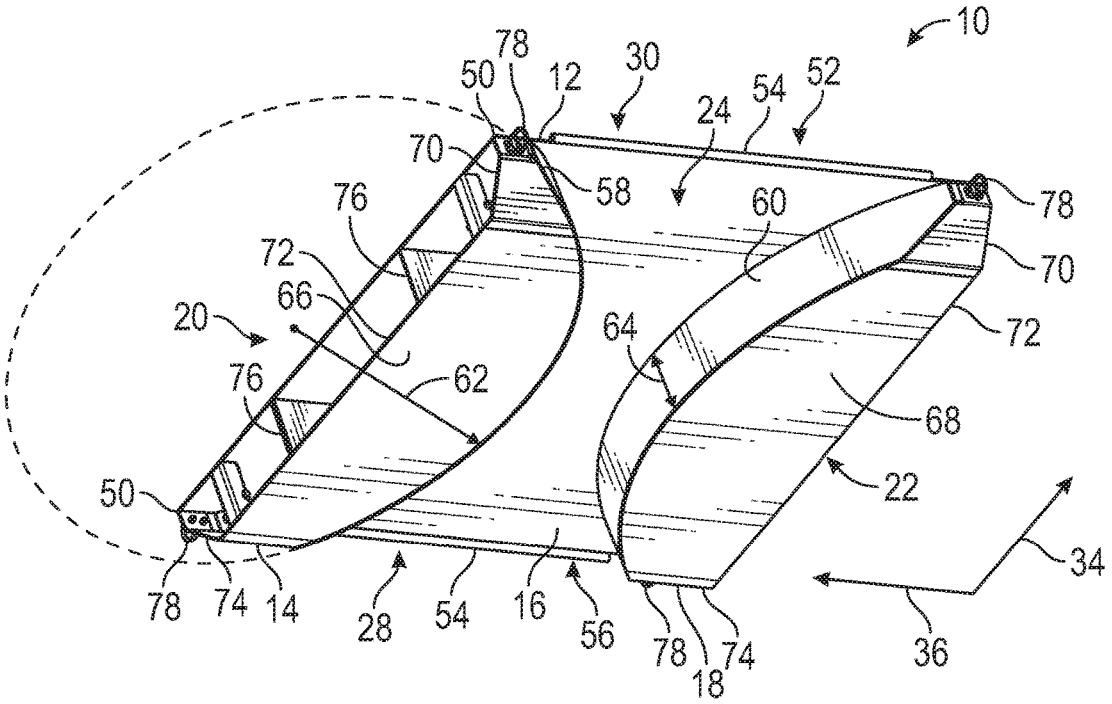
FIG. 2 is a bottom perspective view of a flexible pipe containment sled according to embodiments of the present disclosure.

FIG. 2 illustrates a bottom perspective view of an embodiment of the flexible pipe containment sled 10. As shown in FIG. 2, the platform 12 may have a generally square shape and be made from various metals or metal alloys, such as carbon steel. In other embodiments, the platform 12 may have other shapes, such as, but not limited to, rectangular, circular, oval, triangular, or polygonal shapes. A thickness of the platform 12 may be selected to enable the platform 12 to carry objects or weights as described in more detail below. Although shown with corners 50 with right angles, the platform 12 may have rounded corners in other embodiments. In FIG. 2 the platform 12 includes a third side 52 between the first and second sides 20 and 22. As shown, the third side 52 may include an edge 54 with a curved profile. For example, the edge 54 may be formed or finished with the curved profile. In the illustrated embodiment, a rod or similarly-shaped object, such as a pipe or tube, may be attached to the platform 12 to form the edge 54 with the curved profile. The edge 54 may help to provide a smoother surface for the flexible pipe 26 to contact, thereby reducing the potential for damage to the external surface of the flexible pipe 26. In certain embodiments, the platform 12 includes a fourth side 56 that also includes the edge 54.

As with the platform 12, the first and second sled portions 14 and 18 may be made from various metals or metal alloys, such as carbon steel. As shown in FIG. 2, the first sled portion 14 includes a first inner surface 58 facing the passage 24 and the second sled portion 18 includes a second inner surface 60 facing the passage 24. Both the first and second inner surfaces 58 and 60 have curved shapes. For example, the first and second inner surfaces 58 and 60 may be curved completely from the inlet 28 to the outlet 30, or only a portion of the first and second inner surfaces 58 and 60 may be curved. For example, two curved portions may be coupled to a straight portion. The curved shape of the first and second inner surfaces 58 and 60 may help to provide a smoother surface for the flexible pipe 26 to contact, thereby reducing the potential for damage to the external surface of the flexible pipe 26. Moreover, a radius of curvature 62 of the first and second inner surfaces 58 and 60 may be selected to substantially equal a largest expected bend radius of the flexible pipe 26 to reduce the potential for damage to the flexible pipe 26 when the sled 10 turns a corner in operation. Thus, the flexible pipe 26 may bend along the first inner surface 58 or second inner surface 60 when deploying the flexible pipe 26 through the sled 10.

In addition, a height 64 of the first and second sled portions 14 and 18 may be selected to enable a variety of different diameters of flexible pipe 26 to pass through the passage 24. In other words, the height 64 may be larger than the largest expected diameter of flexible pipe 26. As shown in FIG. 2, the first sled portion 14 may include a first bottom sled surface 66 and the second sled portion 18 may include a second bottom sled surface 68. In certain embodiments, the first and second bottom sled surfaces 66 and 68 may have curved shapes. For example, the first and second bottom sled surfaces 66 and 68 may be curved completely from the inlet 28 to the outlet 30 as described in more detail below, or only a portion of the first and second bottom sled surfaces 66 and 68 may be curved as shown in FIG. 2. For example, the first and second bottom sled surfaces 66 and 68 may include first 70, second 72, and third portions 74 that are each generally flat, but together give the first and second bottom sled surfaces 66 and 68 a generally curved shape. The curved shape of the first and second bottom sled surfaces 66 and 68 may improve the ability of the sled 10 to move over different surfaces, such as bare ground, gravel, grass, dirt, vegetation, or any combination thereof. In particular, the curved shape of the first and second bottom sled surfaces 66 and 68 may help prevent the sled 10 from getting caught on any environmental obstructions. In certain embodiments, the first and second bottom sled surfaces 66 and 68 may be completely flat.

In certain embodiments, sides of the first and second sled portions 14 and 18 opposite from the first and second inner surfaces 58 and 60 may be left open, as shown in FIG. 2, or may be closed. One or more structural members 76 may be used to provide support and stability for the first and second sled portions 14 and 18. In addition, one or more attachment points 78 may be coupled to sled 10. As shown in FIG. 2, the attachment points 78 may be D-rings coupled to the first and second sled portions 14 and 18. In further embodiments, other types of attachment points 78 may be used, such as, but not limited to, rings, shackles, bolts, screws, holes, openings, and so forth. In addition, the attachment points 78 may be coupled to other parts of the sled 10, such as the platform 12. Use of the attachment points 78 is described in more detail below.

Figure 3:
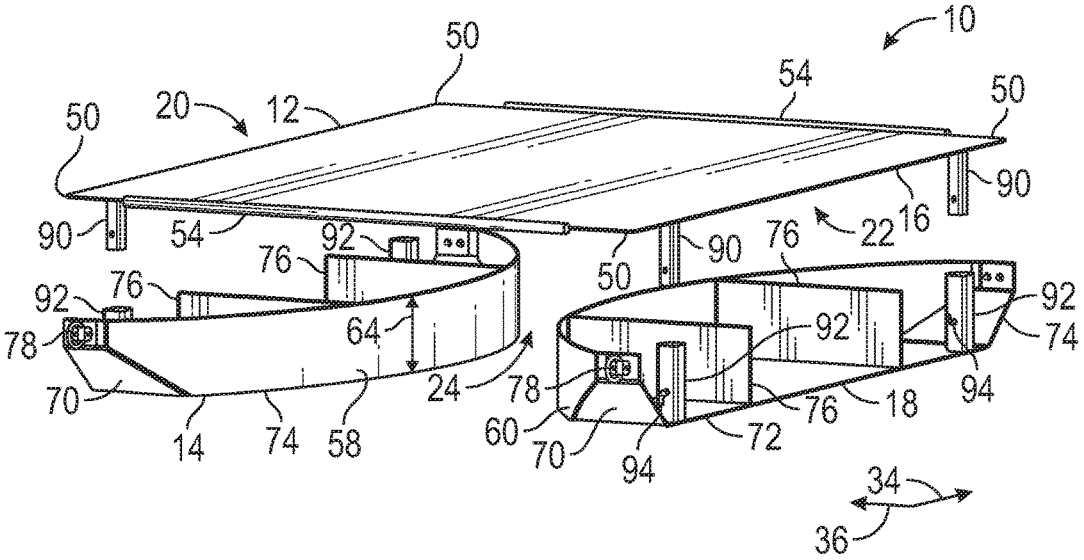
FIG. 3 is an exploded view of a flexible pipe containment sled according to embodiments of the present disclosure.

FIG. 3 illustrates an exploded view of an embodiment of the flexible pipe containment sled 10. Specifically, the platform 12 may be detachably coupled to the first and second sled portions 14 and 18, which may simplify handling and transportation of the sled 10. For example, the sled 10 may take up less space when disassembled. In addition, each of the individual components of the sled 10 (i.e., the platform 12 and the first and second sled portions 14 and 18) may weigh less than the assembled sled 10, thereby making it easier for a person to handle the components individually. Further, individual components of the sled 10 may be selectively replaced or repaired as needed. In certain embodiments, the platform 12 may include a plurality of legs 90 coupled to the lower surface 16. For example, each of the legs 90 may be a portion of square bar stock. The first and second sled portions 14 and 18 may include a plurality of supports 92 to interface with each of the plurality of legs 90. For example, each of the supports 92 may be a portion of hollow square bar stock with interior dimensions greater than the outer dimensions of the legs 90. Thus, the sled 10 may be assembled by placing the first and second sled portions 14 and 18 on a surface appropriately spaced apart from one another, and then lowering the platform 12 onto the first and second sled portions 14 and 18 such that the legs 90 fit within the supports 92. The sled 10 may be disassembled by reversing these steps. In certain embodiments, the legs 90 may be detachably coupled to the supports 92 via fasteners 94, such as, but not limited to, pins, screws, bolts, cotter pins, and so forth. In further embodiments, the platform 12 may be detachably coupled to the first and second sled portions 14 and 18 via other techniques. In some embodiments, the platform 12 may be permanently coupled to the first and second sled portions 14 and 18, such as by welding, brazing, or other techniques. Alternatively, the platform 12 and first and second sled portions 14 and 18 may be formed from one sheet of metal or via additive manufacturing.

Figure 4:
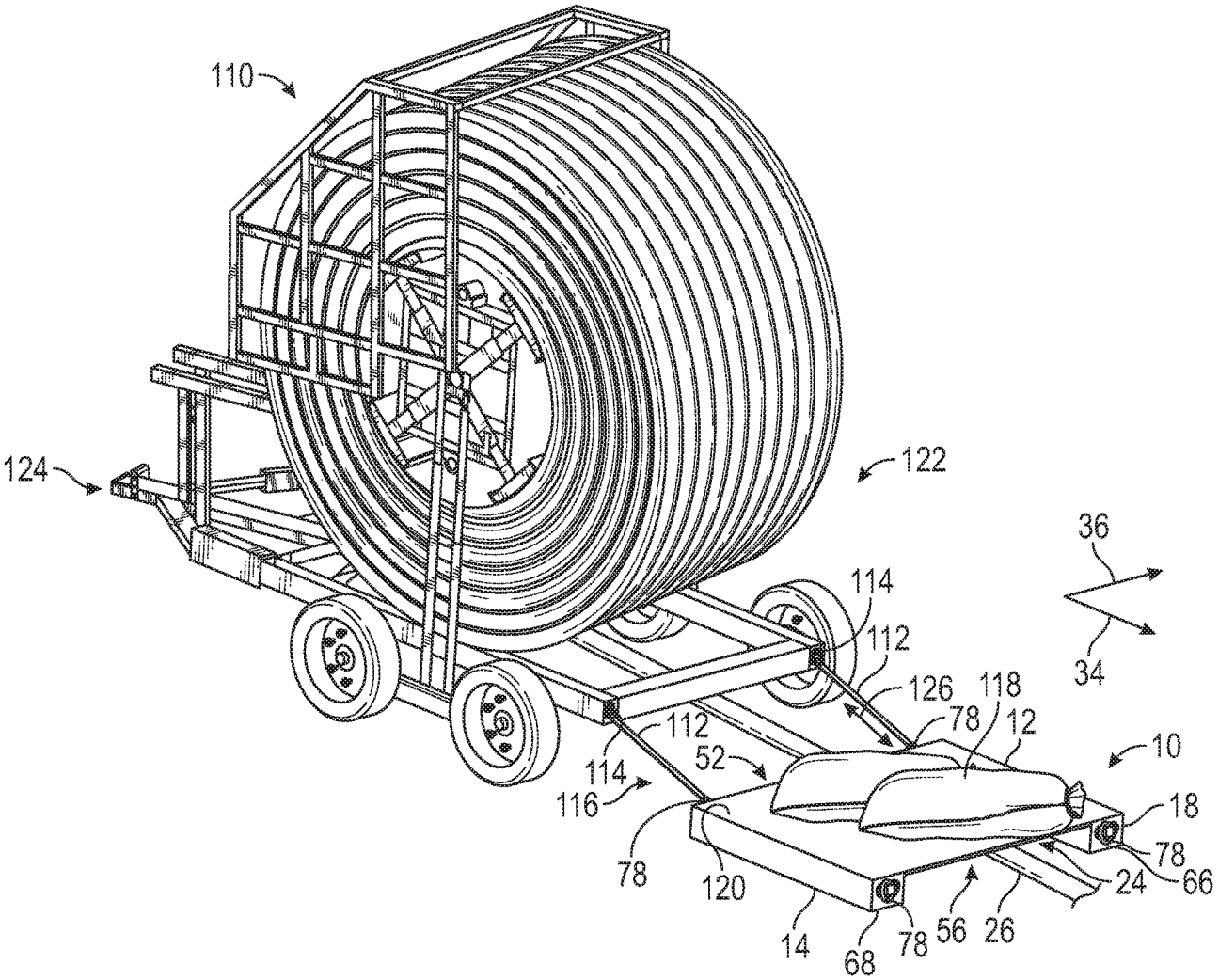
FIG. 4 is a perspective view of a flexible pipe containment sled coupled to a trailer via straps according to embodiments of the present disclosure.

FIG. 4 illustrates a perspective view of the flexible pipe containment sled 10 coupled to a trailer 110 via straps 112. For example, the straps 112 may be coupled to the attachment points 78 of the sled 10 and trailer attachment points 114. The straps 112 may be made from a variety of materials, such as, but not limited to, fabric, polymer, rope, cables, metal chain, metal links, metal tape, and so forth. The trailer attachment points 114 may be similar to the attachment points 78. In addition, a plurality of sleds 10 may be coupled together via the attachments 78 located on the third and fourth sides 52 and 56 of the sleds 10 (e.g., daisy-chained), which may extend the containment effect of the sleds 10 over a longer longitudinal 34 distance. Various embodiments of trailers 110 may be used with the sled 10 and the particular type and style of trailer 110 shown in FIG. 4 is not meant to be limiting. Detachably coupling the sled 10 to the trailer 110 enables the sled 10 to be used with a variety of trailers 110 and also when desired. The flexible pipe 26 may be wound on a spool or reel, or the flexible pipe 26 may be handled as coils without spools or reels, as shown in FIG. 4. Such reels or coils of flexible pipe 26 may reduce the amount of space taken up by pipe during manufacturing, shipping, transportation, and deployment compared to rigid pipe that is not capable of being bent into a coil. In certain embodiments, the flexible pipe 26 may be resistant to unspooling, especially in cold weather. In other words, the flexible pipe 26 may exhibit a memory effect such that the flexible pipe 26 resists being uncoiled. By deploying the flexible pipe 26 through the passage 24 of the sled 10, the weight of the sled 10 may counteract the memory effect such that the sled 10 blocks the flexible pipe 26 from bending or moving upward away from a surface 116. In certain embodiments, the sled 10 may weigh greater than approximately 750 pounds. In other words, the sled 10 helps to maintain the deploying flexible pipe 26 close to the surface 116 by containing the flexible pipe 26 within the passage 24. In addition, the sled 10 may provide an easier, faster, and less expensive technique for addressing the memory effect than other alternatives, such as heating the flexible pipe 26. Although use of the sled 10 may be especially beneficial in cold weather deployment of the flexible pipe 26, embodiments of the sled 10 may be used in all types of climates and temperatures to facilitate deployment.

In certain embodiments, a weight 118 may be placed on an upper surface 120 of the platform 12. The weight 118 may be any heavy or dense object commonly available when deploying the flexible pipe 26, such as, but not limited to, sand bags, lumber, railroad ties, concrete, stones, metal objects, and so forth. Placing the weight 118 on the sled 10 instead of directly on the deploying flexible pipe 26 helps to prevent any possible damage to the external surface of the flexible pipe 26 caused by the weight 118. In addition, the weight 118 helps to provide additional force to the sled 10 to counteract any memory effect of the flexible pipe 26. In certain embodiments, the weight 118 or portions of the weight 118 may be placed in the open sides of the first and second sled portions 14 and 18.

As shown in FIG. 4, the sled 10 may be coupled to a rear side 122 of the trailer 110. In certain embodiments, the trailer 110 may remain stationary and an end of the flexible pipe 26 pulled from the trailer while passing through the sled 10 (e.g., pull-off deployment). In other embodiments, a front side 124 of the trailer 110 may be coupled to a vehicle (e.g., backhoe) used to pull the trailer 110 and sled 10 as the flexible pipe 26 deploys through the sled 10 (e.g., drive-off deployment). In drive-off deployment, the first and second bottom sled surfaces 66 and 68 move over the surface 116. In further embodiments, the trailer 110 may be powered such that the trailer 110 is capable of movement without the use of a separate vehicle. In addition, a length 126 of the straps 112 may be minimized to reduce the amount of flexible pipe 26 that comes off the reel or coil before entering the sled 10.

Figure 5:
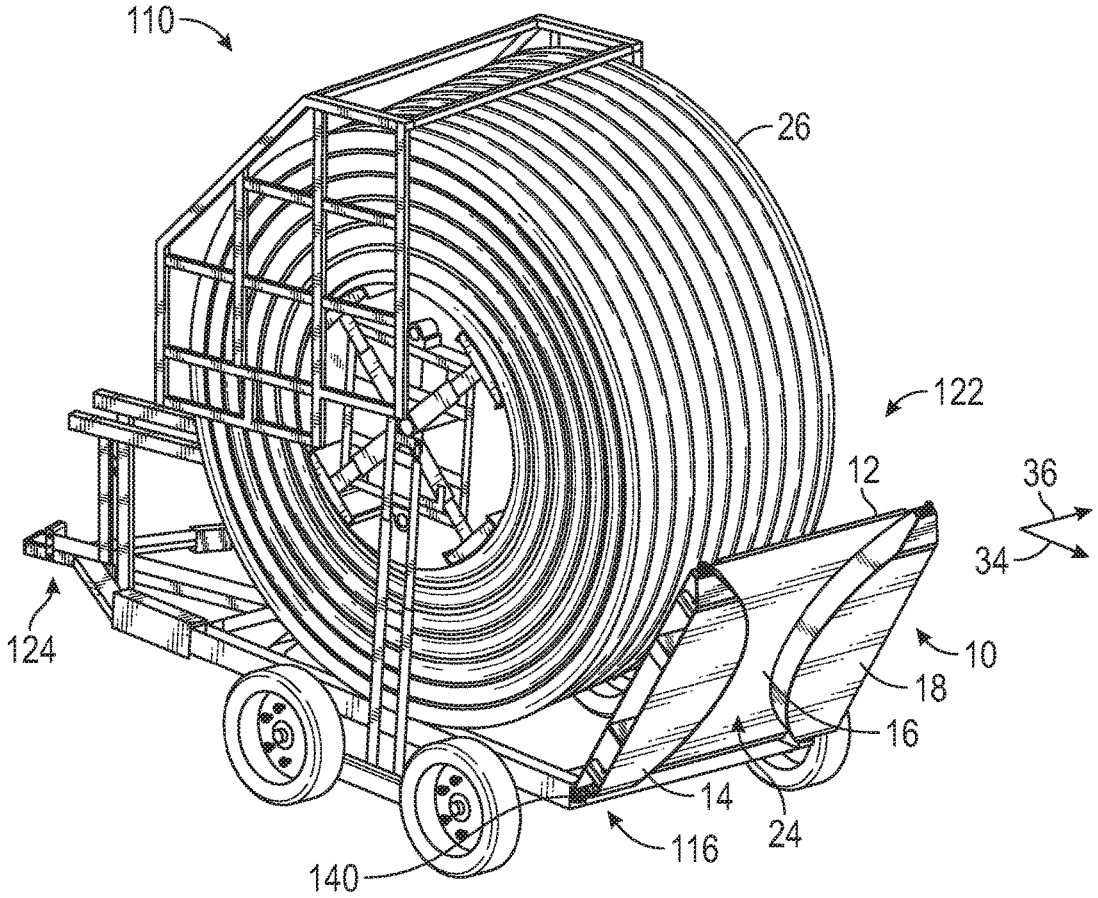
FIG. 5 is a perspective view of a flexible pipe containment sled coupled directly to a trailer according to embodiments of the present disclosure.

FIG. 5 illustrates a perspective view of the flexible pipe containment sled 10 coupled directly to the trailer 110. As shown in FIG. 5, a hinge 140 is configured to couple the sled 10 to the trailer 110 to enable the sled 10 to tilt with respect to the trailer 110. In other words, the sled 10 may be tilted in an upper position as shown in FIG. 5 when the sled is not being used and the sled 10 may be tilted in a lower position for deployment of the flexible pipe 26. In such embodiments, the attachment points 78 described above may be omitted. In addition, the platform 14 may not be detachably coupled to the first and second sled portions 14 and 18. Coupling the sled 10 to the trailer 110 also reduces the amount of flexible pipe 26 that comes off the reel or coil before entering the sled 10.

Figure 6:
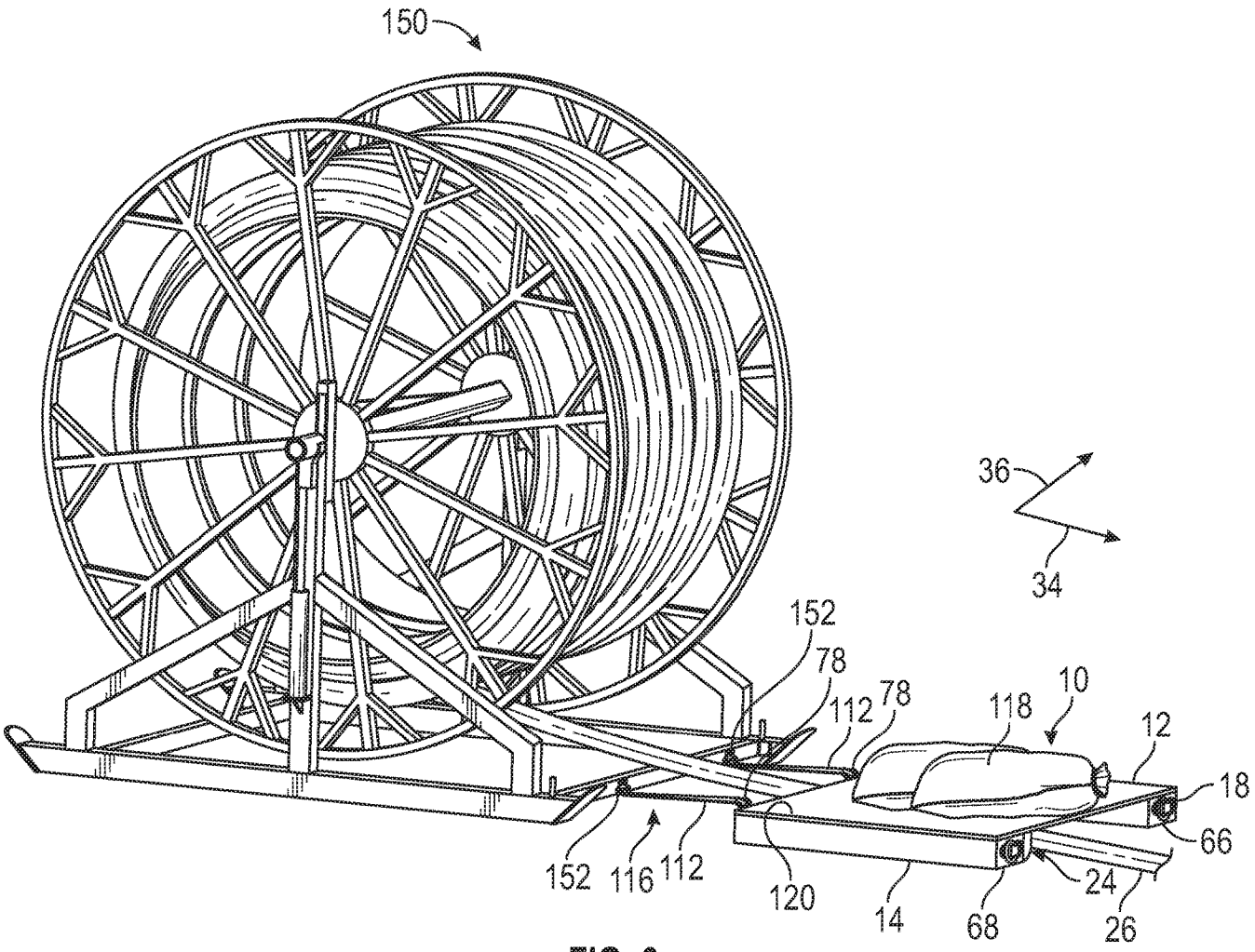
FIG. 6 is a perspective view of a flexible pipe containment sled coupled to a coil frame according to embodiments of the present disclosure.

FIG. 6 illustrates a perspective view of the flexible pipe containment sled 10 coupled to a coil frame 150 via straps 112. For example, the straps 112 may be coupled to the attachment points 78 of the sled 10 and coil frame attachment points 152, which may be similar to the attachment points 78. Various embodiments of coil frames 150 may be used with the sled 10 and the particular type and style of coil frame 150 shown in FIG. 6 is not meant to be limiting. Detachably coupling the sled 10 to the coil frame 150 enables the sled 10 to be used with a variety of coil frames 150 and also when desired. The coil frame 150 may typically remain stationary during deployment of the flexible pipe 26. In other respects, the sled 10 may be used in a similar manner with the coil frame 150 as with the trailer 110 described above.

Figure 7:
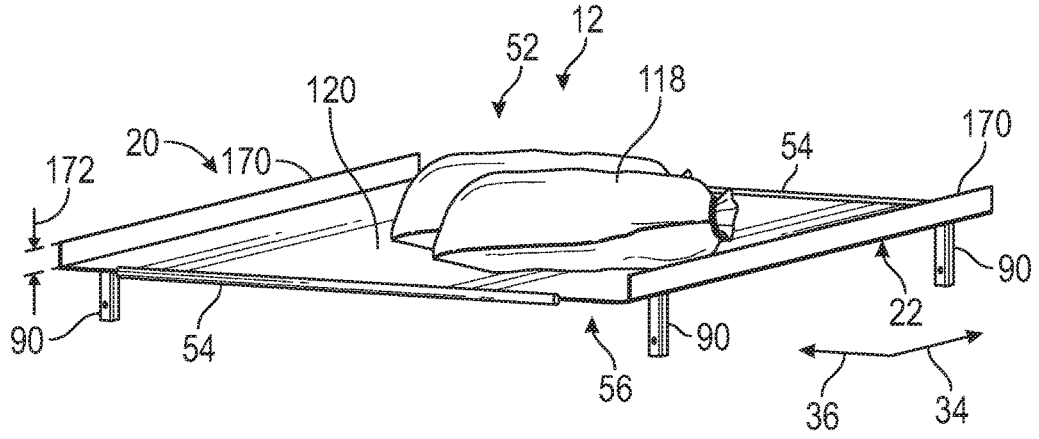
FIG. 7 is a perspective view of a platform of a flexible pipe containment sled with a retaining wall according to embodiments of the present disclosure.

FIG. 7 illustrates a perspective view of the platform 12 of the flexible pipe containment sled 10 with a retaining wall 170. As shown in FIG. 7, the retaining wall 170 is disposed on the upper surface 120. For example, two retaining walls 170 may be disposed at the first and second sides 20 and 22. In certain embodiments, the retaining walls 170 may be made from rectangular bar stock or similar materials, and be made from various metals or metal alloys, such as carbon steel. A height 172 of the retaining walls 170 may be selected to help block the weight 118 from falling off or being dislodged from the first and second sides 20 and 22. Although shown at the edges of the platform 12 in FIG. 7, the retaining walls 170 may be located away from the edges in other embodiments. In addition, certain embodiments of the platform 12 may include retaining walls 170 disposed at the third side 52, the fourth side 56, or both to help block the weight 118 from falling off or being dislodged from those sides. In such embodiments, the edge 54 with the curved profile may be omitted or incorporated into the retaining walls 170.

Figure 8:
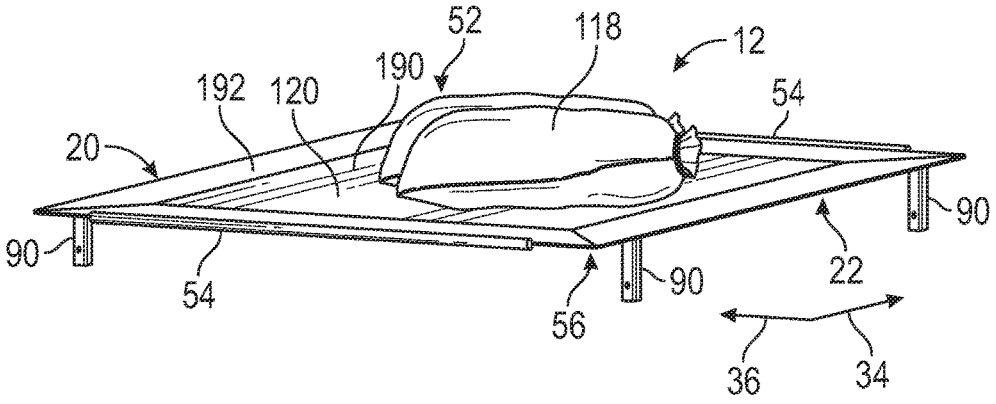
FIG. 8 is a perspective view of a platform of a flexible pipe containment sled with a concave surface according to embodiments of the present disclosure.

FIG. 8 illustrates a perspective view of the platform 12 of the flexible pipe containment sled 10 with a concave surface. As shown in FIG. 8, the upper surface 120 may include a lower portion 190 disposed below an upper portion 192 to provide the concave surface. Thus, the upper portion 192 may act like the retaining walls 170 shown in FIG. 7 to help block the weight 118 from falling off or being dislodged from the first, second, third, and fourth sides 20, 22, 52, and 56. In addition, the arrangement of the lower and upper portions 190 and 192 may help guide the flexible pipe 26 vertically into the passage 24. For example, the upper portions 192 at the third and/or fourth sides 52 and 56 may be angled with respect to the lower portion 190 to form an overall angled profile of the platform 12, which may act in a similar manner to the edge 54 to reduce potential for damage to the external surface of the flexible pipe 26. In such embodiments, the upper portions 192 at the first and second sides 20 and 22 may be omitted. As shown in FIG. 8, the platform 12 may be made from separate components or pieces attached to one another to form the lower and upper portions 190 and 192. Alternatively, the platform 12 may be formed or shaped to provide the lower and upper portions 190 and 192, such as via hammering or working metal to provide the concave surface.

Figure 9:
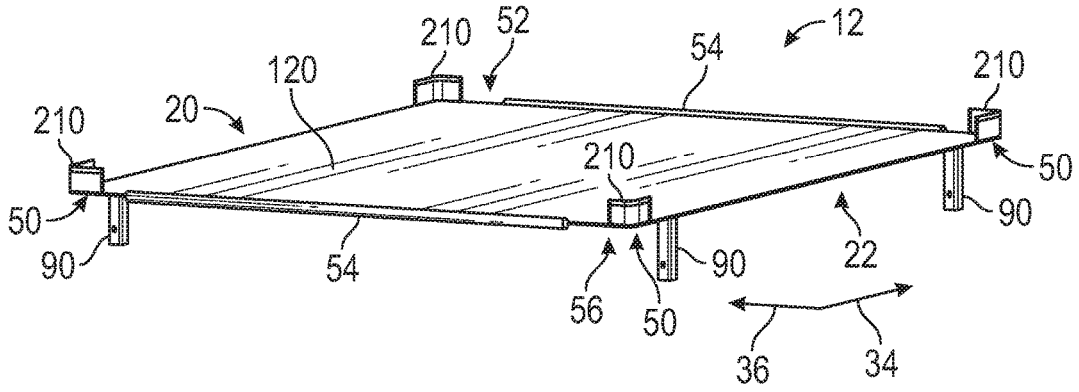
FIG. 9 is a perspective view of a platform of a flexible pipe containment sled with a stacking guide according to embodiments of the present disclosure.

FIG. 9 illustrates a perspective view of the platform 12 of the flexible pipe containment sled 10 with a stacking guide 210. As shown in FIG. 9, the stacking guide 210 is configured to enable a second sled to be stacked on the upper surface 120 of the platform 12. For example, four stacking guides 210 may be disposed at each of the corners 50 of the platform 12. The stacking guides 210 may be made from metal angle stock or metal alloy angle stock. When the second sled is stacked on the upper surface 120, the stacking guides 210 may block the first and second sled portions 14 and 18 of the second sled from moving or sliding off the upper surface 120. In certain embodiments, the stacking guides 210 may be incorporated into the retaining walls 170 shown in FIG. 7 or alternatively, the retaining walls 170 may incorporate the stacking guides 210.

Figure 10:
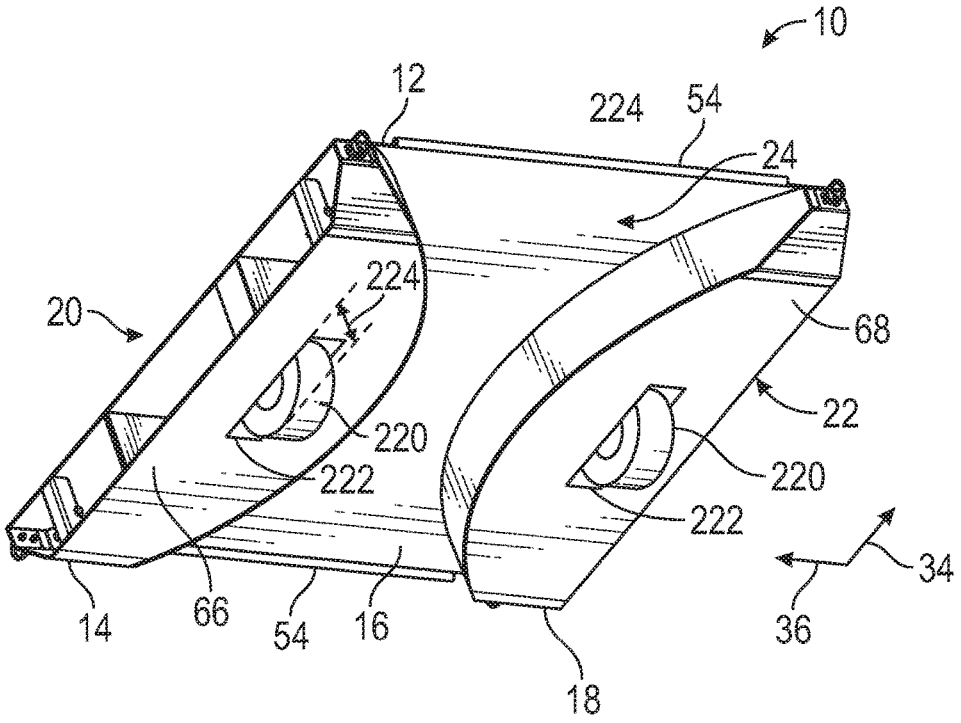
FIG. 10 is bottom perspective view of a flexible pipe containment sled with wheels according to embodiments of the present disclosure.

FIG. 10 illustrates a bottom view of the flexible pipe containment sled 10 with wheels 220. As shown in FIG. 10, the first and second bottom sled surfaces 66 and 68 may have openings 222 through which the wheels 220 protrude. As described above, the sled 10 may move over many types of terrain. As such, the wheels 220 may reduce the resistance or friction of the sled 10 as the sled 10 moves over the terrain. In addition, the wheels 220 may reduce the potential for damage or impact to the first and second bottom sled surfaces 66 and 68 because the surfaces 66 and 68 are raised a distance 224 above the terrain. Examples of wheels 220 include, but are not limited to, solid wheels, solid tires, pneumatic tires, or continuous tracks. The wheels 220 may be made from various materials including, but not limited to, rubber, plastics, metals, metal alloys, and so forth. When the sled is provided with the wheels 220, the first and second bottom sled surfaces 66 and 68 may have curved shapes or may be flat.

Figure 11:
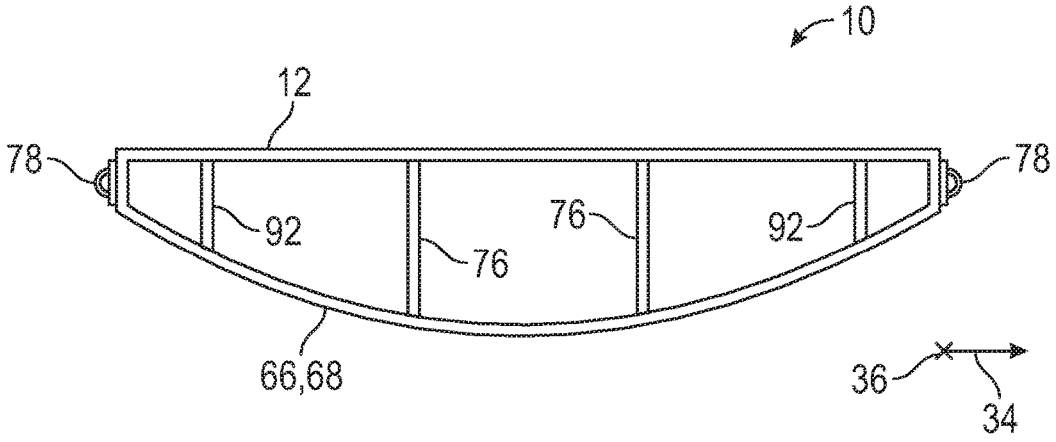
FIG. 11 is a side view of a flexible pipe containment sled according to embodiments of the present disclosure.

FIG. 11 illustrates a side view of the flexible pipe containment sled 10 with the first and second bottom sled surfaces 66 and 68 having a generally continuous curved shape. Such embodiments of the sled 10 may have reduced resistance or friction when moved across certain terrain because less surface area of the first and second bottom sled surfaces 66 and 68 is exposed to the terrain compared to first and second bottom sled surfaces 66 and 68 having one or more flat portions. In certain embodiments, the generally continuous curved shape of the first and second bottom sled surfaces 66 and 68 shown in FIG. 11 may include one or more flat portions.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A flexible pipe containment sled, comprising:

a platform;

a first sled portion coupled to a bottom surface of the platform, wherein the first sled portion is disposed at a first side of the platform;

a second sled portion coupled to the bottom surface of the platform, wherein the second sled portion is disposed at a second side of the platform opposite to the first side of the platform; and a passage formed between the first and second sled portions, wherein the passage is configured to allow a flexible pipe to pass through the passage while the flexible pipe containment sled is placed on a surface; and wherein the platform comprises a third side between the first and second sides, and the third side comprises an edge with a curved profile.

2. The sled of claim 1, wherein the first sled portion comprises a first inner surface facing the passage, the second sled portion comprises a second inner surface facing the passage, and the first and second inner surfaces comprise curved shapes.

3. The sled of claim 1, comprising an attachment point configured to enable the flexible pipe containment sled to be coupled to a trailer or coil frame via a strap.

4. The sled of claim 1, wherein the platform comprises a retaining wall disposed on an upper surface of the platform.

5. The sled of claim 1, wherein an upper surface of the platform comprises a lower portion disposed below an upper portion.

6. The sled of claim 1, wherein the sled is symmetric about an axis passing through the first and second sides of the platform.

7. The sled of claim 1, comprising a hinge configured to couple the flexible pipe containment sled to a trailer and to enable the flexible pipe containment sled to tilt with respect to the trailer.

8. The sled of claim 1, wherein the platform is detachably coupled to the first and second sled portions.

9. The sled of claim 1, wherein the platform comprises a stacking guide configured to enable a second flexible pipe containment sled to be stacked on an upper surface of the platform.

10. The sled of claim 1, wherein the first sled portion comprises a first bottom sled surface, the second sled portion comprises a second bottom sled surface, and the first and second bottom sled surfaces comprise curved shapes.

11. The sled of claim 1, wherein the first sled portion comprises a first bottom sled surface, the second sled portion comprises a second bottom sled surface, and the first and second bottom sled surfaces each comprise a wheel.

12. A method of using a flexible pipe containment sled, comprising:

placing the flexible pipe containment sled on a surface, wherein the flexible pipe containment sled comprises:

a platform;

a first sled portion coupled to a bottom surface of the platform, wherein the first sled portion is disposed at a first side of the platform;

a second sled portion coupled to the bottom surface of the platform, wherein the second sled portion is disposed at a second side of the platform opposite to the first side of the platform, and wherein the platform comprises a third side between the first and second sides, and the third side comprises an edge with a curved profile; and a passage formed between the first and second sled portions; and passing a flexible pipe through the passage.

13. The method of claim 12, comprising weighting the flexible pipe containment sled by placing a weight on an upper surface of the platform.

14. The method of claim 12, comprising bending the flexible pipe along a first inner surface of the first sled portion facing the passage or bending the flexible pipe along a second inner surface of the second sled portion facing the passage, wherein the first and second inner surfaces comprise curved shapes.

15. The method of claim 12, comprising coupling the flexible pipe containment sled to a trailer or coil frame via a strap or a hinge.

16. The method of claim 12, comprising disassembling the flexible pipe containment sled by detachably uncoupling the platform from the first and second sled portions.

17. The method of claim 12, comprising stacking a second flexible pipe containment sled on an upper surface of the platform via a stacking guide of the platform.

18. The method of claim 12, comprising moving the flexible pipe containment sled along the surface via a first bottom sled surface of the first sled portion and a second bottom sled surface of the second sled portion, wherein the first and second bottom sled surfaces comprise curved shapes.

19. The method of claim 12, comprising moving the flexible pipe containment sled along the surface via a first wheel of the first sled portion and a second wheel of the second sled portion.

20. A flexible pipe containment sled, comprising:

a platform;

a first sled portion coupled to a bottom surface of the platform, wherein the first sled portion is disposed at a first side of the platform;

a second sled portion coupled to the bottom surface of the platform, wherein the second sled portion is disposed at a second side of the platform opposite to the first side of the platform; and a passage formed between the first and second sled portions, wherein the passage is configured to allow a flexible pipe to pass through the passage while the flexible pipe containment sled is placed on a surface, wherein the platform comprises a stacking guide configured to enable a second flexible pipe containment sled to be stacked on an upper surface of the platform.

21. A method of using a flexible pipe containment sled, comprising:

placing the flexible pipe containment sled on a surface, wherein the flexible pipe containment sled comprises:

a platform;

a first sled portion coupled to a bottom surface of the platform, wherein the first sled portion is disposed at a first side of the platform;

a second sled portion coupled to the bottom surface of the platform, wherein the second sled portion is disposed at a second side of the platform opposite to the first side of the platform; and a passage formed between the first and second sled portions; and passing a flexible pipe through the passage; and stacking a second flexible pipe containment sled on an upper surface of the platform via a stacking guide of the platform.

* * * * *